US005803111A

United States Patent [19]

Soszka

[11] Patent Number: 5,803,111

[45] Date of Patent: Sep. 8, 1998

[54] DEVICE FOR PURGING WATER SUPPLY LINE

[76] Inventor: Adam Soszka, 79 Yorkview Drive, Etobicoke, Ontario, Canada, M8Z 2G3

[21] Appl. No.: 870,984

[22] Filed: Jun. 6, 1997

[30] Foreign Application Priority Data

Jan. 31, 1997 [CA] Canada ..... 2196486

[51] Int. Cl.[6] ..... F16K 24/00

[52] U.S. Cl. ..... 137/207.5; 137/107; 137/236.1

[58] Field of Search ..... 137/107, 207.5, 137/236.1

[56] References Cited

U.S. PATENT DOCUMENTS

| | | | |
|---|---|---|---|
| 4,096,877 | 6/1978 | Arledge, III | 137/281 |
| 4,269,167 | 5/1981 | Embree | 126/420 |
| 4,355,652 | 10/1982 | Perkins | 137/15 |

OTHER PUBLICATIONS

Cottage Water Systems by Max Burns, published 1993 by Cottage Life Books, pp. 132 to 139.

*Primary Examiner*—Gerald A. Michalsky
*Attorney, Agent, or Firm*—Young & Basile, P.C.

[57] ABSTRACT

An apparatus for purging a water supply line during winter weather conditions using pressurized air includes an air tank capable of holding a sufficient supply of pressurized air to purge the supply line. A valve is connected to an air port of the tank and has a valve member movable between open and closed positions to control the flow of air into and out of the air tank. There is an air bleeder mechanism having an air inlet connectible to the supply line and an air outlet. The mechanism permits air, but not water, to pass from the supply line to the air tank and also permits air to flow back through the mechanism into the supply line. A manually operated valve is used to permit atmospheric air to flow through the air bleeder mechanism to the supply line.

20 Claims, 3 Drawing Sheets

DEVICE FOR PURGING WATER SUPPLY LINE

BACKGROUND OF THE INVENTION

This invention relates to water supply systems for use with a water pump and improvements to such systems.

Private systems for providing water to a residence, cottage or other building are well known. Such systems generally employ a water pump of some sort and a relatively long water supply line that extends to a natural supply of water such as an underground water supply or a nearby lake or other body of water. One type of pump that can be used to provide water from a lake or well is a submersible pump designed to be immersed in water. Better quality pumps of this type can handle suspended sand and turbid water without undue wear. Such pumps have a long life expectancy and are capable of pumping high volumes of water. The pump is attached to the submerged end of a water supply line.

Known water supply lines from the water source to the dwelling can be on the surface, underground, or a combination of the two. Underground lines are more expensive but they tend to be more reliable while surface lines are relatively inexpensive but problematic. Black polyethylene pipe is commonly used for such supply lines since such pipe will not corrode.

It is also known to connect the aforementioned water supply line to a pressure tank that is capable of storing a reasonable supply of water under pressure. The advantage of using such a tank is that it will maintain pressure throughout the water supply lines of the dwelling even when the pump is not operating. A check valve is generally installed close to the inlet of the pressure tank to prevent backflow of water from the pressure tank when the pump shuts off.

Although it can be more difficult to install and maintain a water supply system that is suitable for winter weather conditions, such water supply systems are also known. In such systems, it is necessary to take steps to prevent water from remaining in the water supply line when it is not flowing through the line, at least in those regions of the line that may be subject to freezing conditions. In some cases it may be possible to install the water supply line at a sufficient depth in the ground that it is below the frost line, thus effectively preventing water in the line from freezing. However in many areas, particularly areas where cottages are located, the terrain is rocky or the bedrock is close to the surface of the ground and it can be virtually impossible to bury a water line to a sufficient depth. In those cases where the supply line is above ground or close to the surface thereof, provision must be made to make the water supply line self-draining so that when the pump shuts down, the water in the line will drain back to the water source, leaving the supply line empty. In the case of such supply lines, it is necessary to ensure that the line has sufficient grade that the water in the line will drain out fast enough to avoid freezing. If a submersible pump is being used in this system, the check valve usually mounted on top of the submersible must be removed in order to permit self-draining to occur. However, the removal of this check valve can give rise to problems. The water rushing back down the line after the pump shuts off can spin the submersible motor and impellers as much as three times the designated operating speed and in the reverse direction. This can result in pump failure, particularly if the pump is turned on again while the water is still draining out of the line. The latter problem can be particularly acute if the pressure tank for the system does not have sufficient drawdown, that is the amount of water drained out of the tank before the pressure switch activates the pump. If the pressure tank has sufficient drawdown, this will lessen the possibility that water is still draining from the intake line before the pump is turned on again.

A further difficulty with self-draining water supply lines is that the water will not drain past the level of the source water. Thus, if the source of water is a lake, the water in the pipe at the point where the supply line meets the lake is subject to freezing. The conventional solution to this problem is to use electrical heating cable which can either be wrapped around the exterior of the pipe or be inserted into the pipe. However, the use of such cables can create problems for the home or cottage owner in addition to the cost of operating same. A thermostat must be used to control the operation of the cable and it can be difficult to properly locate the thermostat. Also, a conventional heating cable can only be used if water is maintained in the pipe to be heated. If there is no water in the pipe section to be heated, the pipe could overheat to the point of meltdown. It is often advisable to employ insulation around the pipe in addition to the aforementioned heating cable to help prevent freeze up.

It is an object of the present invention to provide a relatively inexpensive and easy to use device for purging a water supply line during winter weather conditions. Pressurized air from an air tank is used for this purpose.

It is a further object of the invention to provide a safe and reliable apparatus for purging a water supply line that employs a simple air bleeder mechanism and an air tank for holding a supply of air under pressure.

The air tank device disclosed herein can be connected to a water supply line using standard plumbing equipment and it can be operated on an ongoing basis by a home or cottage owner without difficulty by following a set of simple instructions that would normally be provided with the device. With the use of this device, the pressurized air from an air tank can be used to not only purge the water supply line of water after pump shut down but also to lower the level of water in the supply line to a point sufficiently below the level of the lake or other water supply to prevent water freezing inside the supply line.

SUMMARY OF THE INVENTION

According to a first aspect of the invention, an air tank device for purging a water supply line during winter weather conditions using pressurized air includes an air tank capable of holding a sufficient supply of pressurized air to purge a water supply line with the pressurized air. A valve is connected to an air port of this tank and has a valve member movable between an open position in which air is free to flow into or out of said air tank and a closed position in which pressurized air is unable to flow out of the air tank. An air bleeder mechanism has an air inlet connectible to the water supply line and an air outlet. This mechanism permits air, but not water, to pass from the supply line through the mechanism and to the air tank and also permits air to flow back through it into the supply line to facilitate draining and purging the water supply line. There are also means for selectively permitting atmospheric air to flow through the air bleeder mechanism to the water supply line.

In a preferred embodiment, the valve connected to the air port is a manually operated inline valve. The device can include a tee connection connected to the air bleeder mechanism and provided for connecting the air tank device to the water supply line.

According to another aspect of the invention, an apparatus for purging a water supply line during winter weather conditions includes a water line connector having first and second outlets and an inlet connectible to a water supply line. The first outlet is connectible to a water tank for supplying water under pressure. An air bleeder mechanism is connected to a second outlet for permitting air to escape from the supply line upon operation of a water pump connected thereto and for bring air back into the line when the pump shuts off. There is also provided an air tank capable of holding a supply of air under pressure and having an air port and valve means for operatively connecting the air bleeder mechanism to the air port. This valve means includes a valve member movable between an open position in which air can flow either into the air tank from the air bleeder mechanism or out of the air tank to the air bleeder mechanism and a closed position in which pressurized air is unable to flow out of the air tank.

In a preferred embodiment, the air bleeder mechanism includes a check valve through which air can pass in either of two directions and through which water cannot flow from the line connector towards the air tank.

According to a further aspect of the invention, a water supply system for use with a pump and suitable for winter weather conditions includes a water supply line connectible to a pump and a line connector with first and second outlets and a water inlet, the latter connectible to the supply line. There is also a one way check valve operatively connected to the first outlet and connectible to a pressure tank for supplying water. This check valve permits water to flow in one direction only to the pressure tank. An air tank capable of holding a supply of air under pressure and having an air inlet is included in the system together with line and valve means for connecting the air tank to the line connector. The line and valve means include an air bleeder valve arrangement for permitting air to escape from the supply line upon operation of the pump and for bringing air back into the line when the pump shuts off. A further valve is arranged between the air bleeder valve arrangement and the air inlet of the tank and is movable between an open position in which air can flow into or out of the air tank and a closed position in which pressurized air is unable to flow out of the air tank. Also, the air bleeder valve arrangement has an open position where air from the supply line can escape to atmosphere upon operation of the pump and a closed position where air from the supply line can pass into the air tank and pressurize same upon operation of the pump.

Preferably, the air bleeder valve arrangement includes another check valve through which air can flow in either of two directions and through which water cannot flow from the line connector and a manually operated valve movable between open and closed positions.

Further features and advantages will become apparent from the following detailed description taken in conjunction with the accompanying drawings.

DETAILED DESCRIPTION OF PREFERRED EMBODIMENT

Figure 1:
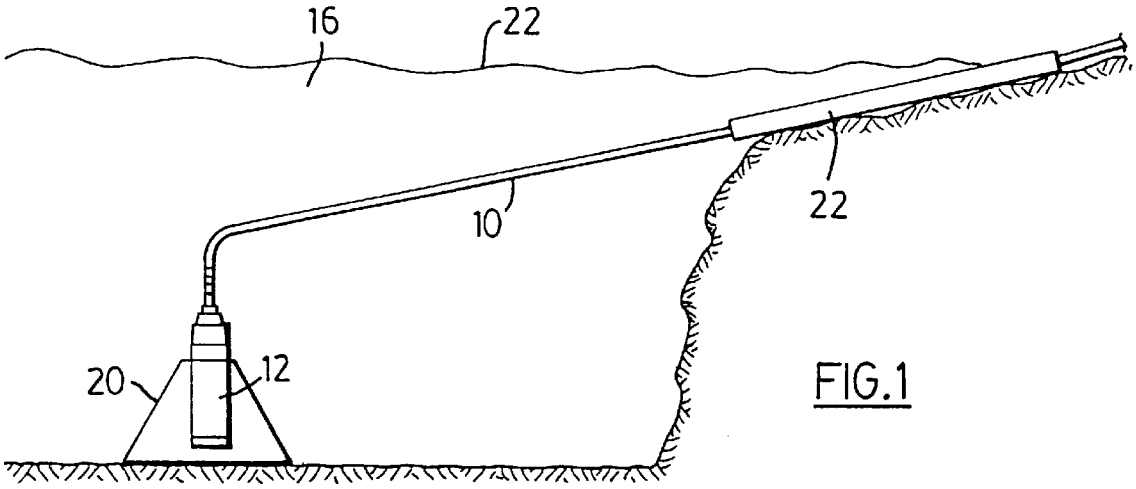
FIG. 1 is a schematic elevational view illustrating the mounting of a submersible pump at the bottom of a body of water and a water supply line extending therefrom.

The water supply system described herein employs a combination of valves, connectors and an air tank capable of automatically draining a water supply line 10. This system is preferably used in combination with a standard submersible water pump 12 and a pressure tank 14 which can be of known construction. After the pressure tank 14 is filled with water by operation of the pump, water in the line 10 automatically drains back to the outside water source which can be a lake 16 or other suitable body of water. The water must drain out quickly in winter weather conditions when the pump shuts off so that the water in the line will not freeze. By constructing the water supply system in the manner described hereinafter and by providing a suitable slope to the water line as shown in FIG. 1 where it is subject to freezing conditions, freeze up of water in the line can be avoided. A suitable minimum slope for the water supply line is 1 in 13. In other words, for every 13 units of measure that the line runs horizontally, it should drop a minimum of 1 unit vertically. The water line can of course have a greater slope if installation conditions permit.

It will be understood that the standard pressure tank 14 which is located inside the dwelling or cottage and which supplies water under pressure to the various water lines and faucets located in the building is equipped with a standard pressure switch indicated schematically at 18. This switch controls the operation of the submersible pump 12 and it signals the pump to start delivering water through the supply line whenever the water level in the tank falls to a predetermined level.

As illustrated in FIG. 1, the pump 12 is generally mounted on a pump stand 20 which can be of standard construction and which, in the illustrated version, does not protrude above the water level indicated at 22.

The illustrated intake line 10 extends to the shoreline and then over the surface of the ground as illustrated in FIG. 1. Preferably the region of the line at the water's edge is covered with suitable ABS pipe in order to provide a protective sleeve for the water pipe at this location.

Figure 4:
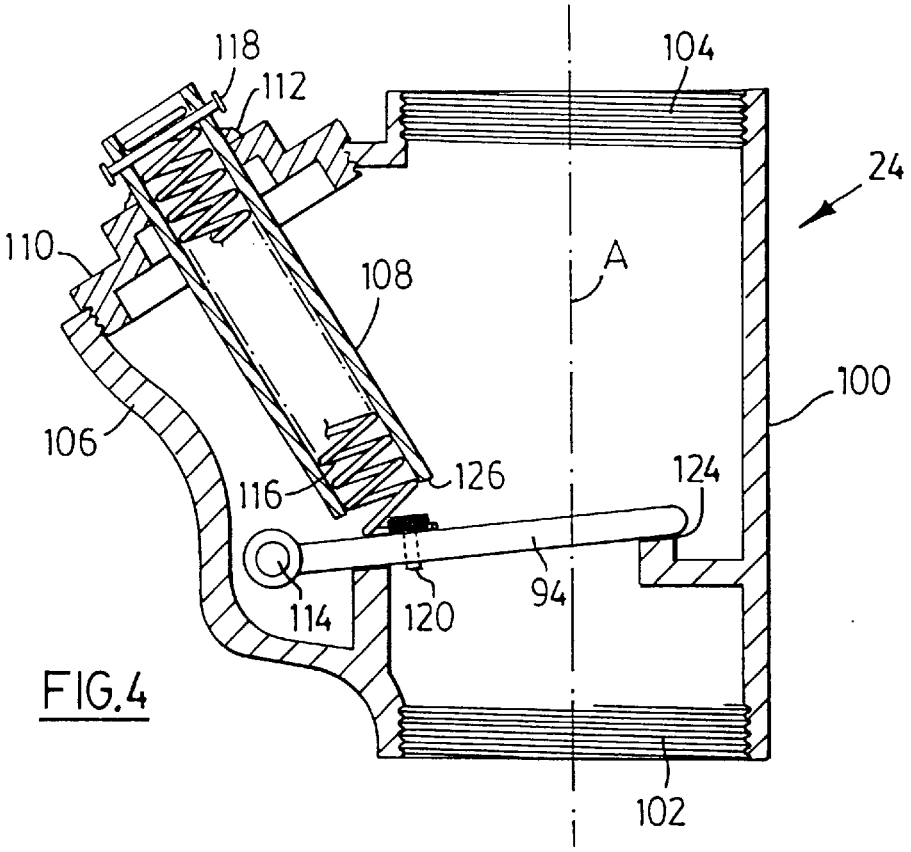
FIG. 4 is an axial cross-section of a two-way diverter valve usable with the water supply system.

Submersible pumps come equipped with a check valve mounted on top thereof provided for the purpose of protecting the pump from damage when it is shut off and water rushes back down the line 10. For purposes of the present invention, this check valve is removed and replaced by a two-way diverter valve 24. One preferred form of diverter valve is shown in FIG. 4 and it is described in greater detail hereinafter. Other forms of two way diverter valves are also known in the valve industry. Briefly, the valve 24 prevents water from flowing back into the pump 12 when the pump is shut off. Instead, the water flows out through a second outlet at 26. Connected above the valve 24 by means of a short pipe connection 28 is a pressure reducing valve 30 of standard construction. This valve helps to reduce pressure from the back flowing water when the line 10 is draining. It does not affect the flow of water under pressure up through the line 10 when the pump is on.

Figure 3:
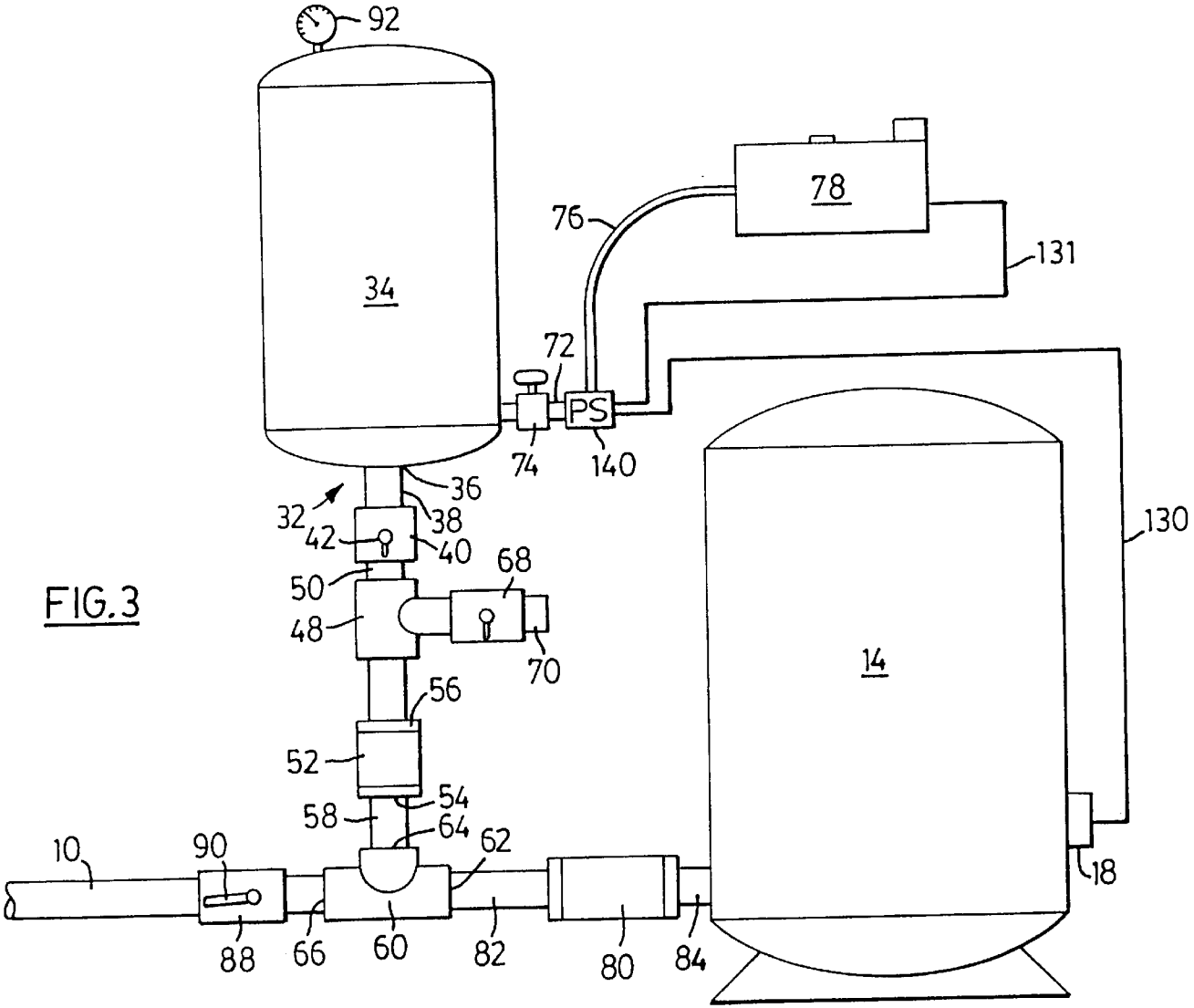
FIG. 3 is a side elevation of an apparatus for purging the water supply line during winter weather conditions, this apparatus being constructed in accordance with the invention.

Turning now to the air tank device of the invention as shown in FIG. 3, which device is indicated generally at 32, it will be understood that this device is capable of purging the supply line 10 during winter weather conditions using pressurized air. The device includes an air tank 34 capable of holding a sufficient supply of pressurized air to purge the supply line 10 with this air. It will be understood that the size of the tank can vary and the size required will depend upon several conditions, including the length of the supply line 10 and the expected severity of the winter weather, which would of course effect the depth to which the water will freeze on the outdoor water source. It is recommended that the capacity of the air tank should normally be a minimum of 5 imperial gallons for every 100 feet of one inch water supply line. The tank has a main air port 36 located at the bottom of the tank. The port 36 should be at the bottom in order to avoid any water buildup in the air tank. It will be understood that the tank is adequately supported by a supporting frame (not shown) or any other suitable rigid support of sufficient strength.

Figure 5:
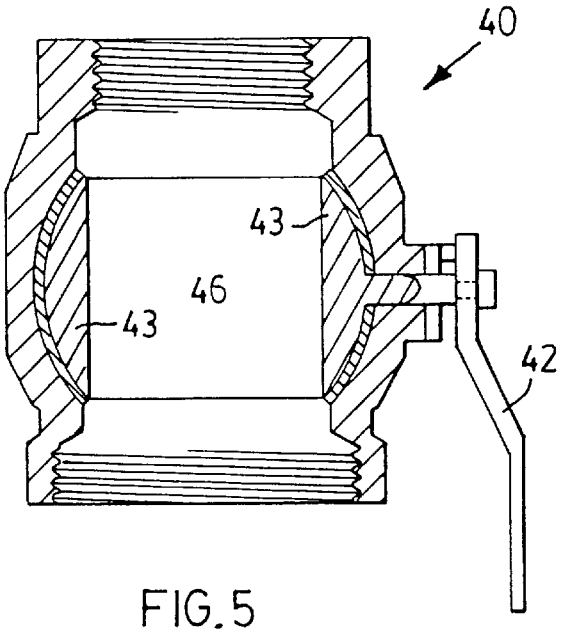
FIG. 5 is an axial cross-section of a standard ball valve in the open position.

Connected to the air tank by means of a short pipe connector 38 is an in-line valve 40 which can be a standard manually operated ball valve having a valve member 43 movable between an open position in which air is free to flow into or out of the air tank 34 and a closed position in which pressurized air is unable to flow out of the air tank. The valve member can be operated by means of a simple external lever 42. The interior of the ball valve 40 is shown in FIG. 5. The valve member 43 in the valve comprises a pivoting metal ball having a hole 46 for the passage of air extending through it. In the open position of the valve, air can pass in either direction through the hole 46. In the closed position, the hole 46 is blocked off. The valve 40 is an optional feature and is not required if the tank 34 is connected to an air compressor 78 or can be connected to such an air compressor to add additional air to the system and in particular to the tank 34 as explained further below. However, air compressors are relatively expensive and the use of one can be avoided if the valve 40 is provided as explained below.

Located below the valve 40 is a tee connector 48 which can be connected to the valve 40 by means of a short pipe section 50. Located below the tee connector is an air bleeder mechanism 52 which can be a three function, metal swing check valve of known construction. This mechanism or valve has an air inlet at 54 and an air outlet at 56. It will be understood that this bleeder mechanism or valve permits air, but not water, to pass from the supply line 10, through the bleeder mechanism and to the air tank 34 and also permits air to flow back through the mechanism into the water supply line 10 to facilitate draining and purging the supply line. A short pipe coupling 58 connects the inlet of the air bleeder mechanism to a tee connector 60. The connector 60 has a first water outlet 62, a second water outlet 64 and a water inlet 66, the latter connectible to the supply line 10.

The air tank device 32 also has means for selectively permitting atmospheric air to flow through the air bleeder mechanism 52 to the water supply line. This mechanism in the illustrated preferred embodiment comprises a manually operated ball valve 68 which is mounted between the valve 40 and the air bleeder mechanism 52 by means of the tee connector 48. When the ball valve 68 is moved to an open position, atmospheric air can enter through an air inlet at 70. It should be understood that the illustrated use of the ball valve 68 to introduce atmospheric air into the system is only one possible means for permitting atmospheric air to flow through the air bleeder mechanism. Another possible way of introducing atmospheric air would be to provide an additional air inlet such as the illustrated inlet 72 which leads into air tank 34. The inlet 72 can be opened or closed by means of a valve 74. It will be understood that although the illustrated inlet 72 is shown as connected to a compressed air line 76 and an air compressor 78, the use of which is described hereinafter, the device can be operated and used without the line 76 and the air compressor 78 in which case the opening 72 can simply provide an opening to atmosphere.

It will be noted that the use of and provision of the ball valve 68 is optional and is not essential if an air compressor is connected to the tank 34 as shown or is available for connection thereto. However, the provision of the valves 40 and 68 can avoid the need to use an air compressor 78 as explained hereinafter.

There is also shown in FIG. 3 a one way check valve 80 of standard construction. This valve is connected by means of pipe couplings 82 and 84 to the first water outlet of the tee connector 60 and to the bottom of pressure tank 14. The purpose of the check valve 80 is to only permit water subject to a predetermined level of pressure to enter the tank 14. In this way and in a known manner, any air that may be in the supply line upon start up of the system cannot enter the pressure tank 14. Furthermore, the check valve 80 prevents the backflow of water from the pressure tank 14 into the supply line. In other words, the check valve 80 permits water to flow in one direction only into the pressure tank.

An optional preferred feature of this water supply system is the use of a further inline valve 88 which is mounted in the supply line 10 near the tee pipe connector 60 and movable between closed and open positions to control water flow through the supply line. The valve 80 can be a standard, manually operated ball valve, similar to that shown in FIG. 5. It is provided with a control lever 90 capable of pivoting the internal ball valve member. The valve 88 is normally open and its only purpose is to keep water out of the system when the water supply system is not in use. Thus, the valve 88 is closed when the system is not being used and has been shut down.

A pressure gauge 92 is preferably installed on or near the air tank 34 in order to record any air loss from the tank when it is pressurized as described hereinafter. Some air in the system will be absorbed by water running through the system during normal pump operation. If desired, further air under pressure can be added to the air tank 34 by means of a small, standard air compressor 78 which can be connected to the air tank via the aforementioned line 76 and air inlet 72 when the valve 74 is opened. It is also possible to add further air using the charging technique described hereinafter without using an air compressor.

Figure 2:
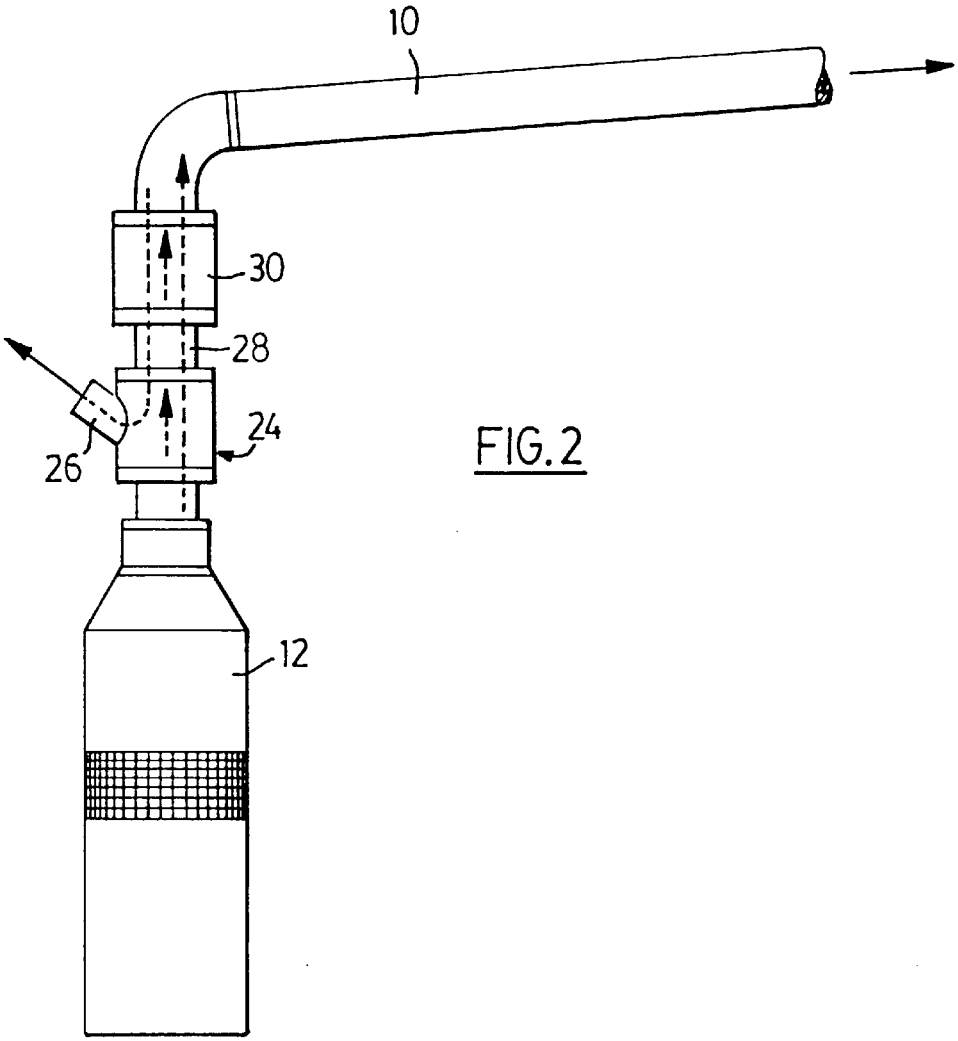
FIG. 2 is a side view of a submersible pump connected to two separate valves and a water supply line.

The operation and use of the above described water supply system will now be explained with reference to FIGS. 1 to 3. In order to initially charge the supply system with water, the pump 12 is started using its own electrically powered motor. The outlet 26 in the diverter valve is closed by a movable valve member 94 mounted therein. Water is pumped up through the pressure-reducing valve 30 and through the supply line 10. The supply of water pushes the air in the line 10 through it and into the air tank 34 which is sealed except for its inlet at 36. The air can also pass out through the ball valve 68 which is initially open for this charging step. Once the air has passed out of the line 10 and has reached the air bleeder mechanism or check valve at 52, this mechanism or valve closes and prevents the flow of water therethrough. The water is then forced to flow into the pressure tank 14 through the check valve 80 and fills this tank.

When the tank 14 is full, the pressure switch 18 on the tank will cause the pump to stop operating. Then, the check valve 52 permits air from the air tank 34 and from open valve 68 to flow back into the supply line 12, thereby permitting and hastening the draining process. It will be appreciated that if a vacuum is created in this supply line by back flowing water, this will prevent draining of the supply line. It might be noted here that the ball valve at 40 is normally left open and is closed temporarily as explained below when the valve 68 is open to permit extra air to flow into the system.

After this initial charging operation, it will be noted that the air will extend downwardly in the supply line 10 only to the point where the air reaches the water level 22 of the water source. In order to introduce additional air into the system and in order to prevent freeze up, after the initial charging operation has taken place, the ball valve 68 is closed and the pump 12 is started again, normally by opening a tap in the dwelling's water system to permit a drop off in the water pressure in the tank. The result is that air which is now trapped in the supply line 10 is pumped into the air tank 34 causing this tank to become pressurized. For this to occur, the ball valve 40 is of course left open. After the air tank has become pressurized, the valve 40 is closed and the valve 68 is opened. This causes pressure to be retained in the air tank 34 while at the same time permitting the inflow of air into the system to allow the intake line 10 to drain again. Then, after a few minutes, the ball valve 68 is closed and the valve 40 is opened. It will be appreciated that this results in considerably more air in the water supply system than is required simply to fill the pipes. Because of this, whenever the pump shuts down subsequently, air from the pressurized tank 34 will flow through the line 10 and down to the vicinity of the pump 12. Thus, the system will effectively be protected at all times against freeze up during winter conditions, even in the region of the supply line where the line passes from the ground surface and into the lake or river.

Of course, instead of using the aforementioned system for introducing additional air into the system, it is also possible to use the aforementioned air compressor 78 to pump additional air into the tank 34 after the initial charging process. This alternative, of course, requires the availability of a suitable air compressor.

The construction of the preferred diverter valve 24 will now be described in more detail with reference to FIG. 4. The valve includes a metal valve body 100 which can be made of a suitable non-rusting metal such as brass. This body has a circular, internally threaded inlet 102 which is connectible to an outlet of the pump and a circular, internally threaded, main outlet 104. The valve body has an extension 106 on one side with a central axis that extends at an acute angle to the main central axis indicated at A. This acute angle can be approximately 45 degrees in the preferred embodiment. A hollow, cylindrical tube 108 open at both ends is co-axial with the central axis of the extension 106 and it extends into the main section of the valve body. The tube 108 is attached to a threaded plug 110 which caps the extension 106. The tube 108 can be rigidly attached to the plug by welding or solder at 112.

A hinged gate or valve member 94 is secured by means of a shaft 114 which is fitted in a suitable hole drilled into the valve body. A suitable, rust resistant metal spring 116 is mounted centrally in the tube 108 and can run the length thereof as shown. It is secured at the top of the tube by means of a pin 118. The bottom end of the spring extends around the head of a pin 120 which forms a seat to hold the spring end in the proper position.

It will be understood that the gate 94 with the aid of the coil spring regulates the direction of water passing through the diverter valve 24. The valve member is movable between a first valve seat located at 124 and a smaller, second valve seat 126. Thus, when the gate 94 rests against the first valve seat 124, the flow of water back into the pump 12 is substantially prevented. This will take place whenever there is a significant backflow of water in the line 10. However, when the pump commences operation, the force of the water from the pump will effectively push the gate 94 against the second valve seat 126, preventing the outflow of water through the tube 108 and permitting the pressurized water to flow from the pump and up through the supply line 10. It should be noted that the purpose of the coil spring 116 is to provide an additional downward force on the hinged gate 94 so that when the pump is not operating, not only the downward pressure of the water flowing through the opening 104 but also the force of the spring will pivot the gate against the valve seat 124.

A further optional feature that can be provided in the water supply system of the invention involves the automatic operation of the air compressor 78 by means of electrical power supply wires 130 shown in FIG. 3. These power supply wires are connected to the pressure switch 18 of the pressure tank and it is set up to operate the air compressor 78 whenever the pump is working. The air compressor 78 will stop when the water pump stops because it gets its power from the pressure switch 18 for the pump. As an extra safeguard, an adjustable air pressure switch 140 can be operatively connected to the air tank and acts to turn the power off to the air compressor should the air pressure in the tank 34 exceed a preset limit. By this arrangement, more draining power (by means of more compressed air in the tank 34) can be provided. This helps to ensure that there is sufficient compressed air in the system to push the water out of the line and back to the pump. Electrical power supply wires at 131 extend from the pressure switch to the compressor 78 and provide electrical power thereto. Thus, if the pressure in the air tank 34 should exceed the preset limit, the switch 140 will open and thus cut-off power to the air compressor even though the pump itself may continue to operate.

It will be apparent to those skilled in this art that various modifications and changes can be made to the described water supply system without departing from the spirit and scope of this invention. Accordingly, all such variations, modifications and changes as fall within the scope of the appended claims are intended to be part of this invention.

I claim:

1. A water supply system for use with a pump and suitable for winter weather conditions comprising:

a water supply line connectible to a pump;

a line connector with first and second water outlets and a water inlet, the latter connectible to said supply line;

a one-way check valve operably connected to said first outlet and connectible to a pressure tank for supplying water, said check valve permitting water to flow in one direction only into said pressure tank;

an air tank capable of holding a supply of air under pressure and having an air inlet; and line and valve means connecting said air tank to said line connector, said line and valve means including an air bleeder valve arrangement for permitting air to escape from said supply line upon operation of said pump and for permitting air back into said line when said pump shuts off and a further valve arranged between said air bleeder valve arrangement and said air inlet and movable between an open position in which air can flow into or out of said air tank and a closed position in which pressurized air is unable to flow out of said air tank;

wherein said air bleeder valve arrangement has an open position where air from said supply line can escape to atmosphere upon operation of said pump and a closed position in which air from said supply line can pass into said air tank and pressurize same upon operation of said pump.

2. A water supply system according to claim 1 wherein said air bleeder valve arrangement includes another check valve through which air can flow in either of two directions and through which water cannot flow from said line connector and a manually operated valve movable between said open position where air can escape to atmosphere and said closed position where air can pass from said another check valve into said air tank but air cannot escape to atmosphere.

3. A water supply system according to claim 2 wherein said manually operated valve is a ball valve connected to a tee-connection which is part of said line and valve means, said tee connection being mounted between said another check valve and said further valve.

4. A water supply system according to claim 1 including a diverter valve connectible to an outlet of said pump for allowing water to drain out of said supply line.

5. A water supply system according to claim 4 wherein said diverter valve is a two-way diverter valve containing a pivoting valve member movable between a first valve seat and a second valve seat, and wherein when said valve member rests against said first valve seat, flow of water back into said pump is prevented, and when said valve member rests against said second valve seat, pressurized water can flow from said pump and through said supply line.

6. A water supply system according to claim 4 wherein-said line connector is a tee pipe connector and an in-line valve is mounted in said supply line near said tee pipe connector, this in-line valve being movable between closed and open positions to control water flow through said supply line.

7. A water supply system according to claim 4 wherein said further valve arranged between said air bleeder valve arrangement and the air inlet of the air tank is a manually operated in-line ball valve.

8. A water supply system according to claim 1 wherein an air pressure gauge is operatively connected to said air tank.

9. A water supply system according to claim 1 including an air compressor connectible to a further air inlet of said air tank for pumping compressed air into said air tank.

10. An apparatus for purging a water supply line during winter weather conditions, said apparatus including:

a water line connector having first and second outlets and an inlet connectible to a water supply line, said first outlet being connectible to a water tank for supplying water under pressure;

an air bleeder mechanism connected to said second outlet for permitting air to escape from said supply line upon operation of a water pump connected thereto and for permitting air back into said line, when said pump shuts off;

an air tank capable of holding a supply of air under pressure and having an air port; and valve means for operatively connecting said air bleeder mechanism to said air port of the air tank, said valve means including a valve member movable between an open position in which air can flow either into said air tank from said air bleeder mechanism or out of said air tank to said air bleeder mechanism and a closed position in which pressurized air is unable to flow out of said air tank.

11. An apparatus for purging a water supply line according to claim 10 wherein said air bleeder mechanism includes a check valve through which air can pass in either of two directions and through which water cannot flow from said line connector towards said air tank.

12. An apparatus for purging a water supply line according to claim 11 wherein said valve means is a manually operated ball valve.

13. An apparatus for purging a water supply line according to claim 11 including an in-line check valve and said water tank for supplying water under pressure, said in-line check valve being installed between said first outlet and said water tank and permitting water to flow in one direction only into said water tank from said line connector.

14. An apparatus for purging a water supply line according to claim 11 including an in-line check valve connected to said first outlet to prevent water flowing back into said supply line from said water tank.

15. An apparatus for purging a water supply line according to claim 11 wherein said air bleeder mechanism includes a manually operated ball valve movable between an open position for allowing air from said supply line to escape to atmosphere and a closed position in which air from said supply line is forced to flow into said air tank upon operation of said water pump.

16. An air tank device for purging a water supply line during winter weather conditions using pressurized air, said device comprising:

an air tank capable of holding a sufficient supply of pressurized air to purge a water supply line with said pressurized air, said tank having an air port;

a valve connected to said air port and having a valve member movable between an open position in which air is free to flow into or out of said air tank and a closed position in which pressurized air is unable to flow out of said air tank;

an air bleeder mechanism having an air inlet connectible to said water supply line and an air outlet, said bleeder mechanism permitting air, but not water, to pass from said supply line, through said air bleeder mechanism and to said air tank, and permitting air to flow back through said air bleeder mechanism into said water supply line to facilitate draining and purging said water supply line; and means for selectively permitting atmospheric air to flow through said air bleeder mechanism to said water supply line.

17. An air tank device according to claim 16 including a tee-connection connected to said air bleeder mechanism and provided for connecting said air tank device to said water supply line.

18. An air tank device according to claim 16 wherein said permitting means is a manually operated ball valve mounted along a pipe line between said valve connected to the air port and said air bleeder mechanism.

19. An air tank device for purging a water supply line during winter weather conditions using pressurized air, said device comprising:

an air tank capable of holding a supply of pressurized air to purge a water supply line with said pressurized air, said tank having an air port, air compressor means connectible to said air tank to provide pressurized air to said air tank when required;

an air bleeder mechanism having an air inlet connectible to said water supply line and an air outlet, said bleeder mechanism permitting air, but not water, to pass from said supply line, through said air bleeder mechanism and to said air tank, and permitting air to flow back through said air bleeder mechanism into said supply line to permit draining and purging said water supply line; and means for selectively permitting exterior air into said device.

20. An air tank device according to claim 19 including a manually operated valve connected to said air port and having a valve member movable between an open position in which air is free to flow into or out of said air tank and a closed position in which pressurized air cannot flow from said air tank to said air bleeder mechanism.

* * * * *